US011867004B2

(12) United States Patent
Al Harthi

(10) Patent No.: US 11,867,004 B2
(45) Date of Patent: Jan. 9, 2024

(54) SYSTEMS AND ASSEMBLIES FOR PREVENTING UNDESIRED HIGH SPEED ROTATION OF POWER TONGS

(71) Applicant: Saudi Arabian Oil Company, Dhahran (SA)

(72) Inventor: Amer Hamoud Al Harthi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 443 days.

(21) Appl. No.: 17/208,313

(22) Filed: Mar. 22, 2021

(65) Prior Publication Data

US 2022/0298873 A1 Sep. 22, 2022

(51) Int. Cl.
*E21B 19/16* (2006.01)

(52) U.S. Cl.
CPC ..... *E21B 19/161* (2013.01)

(58) Field of Classification Search
CPC .... E21B 19/161; E21B 19/162; E21B 19/163; E21B 19/164
See application file for complete search history.

(56) References Cited

U.S. PATENT DOCUMENTS 4,593,584 A 6/1986 Neves
7,281,451 B2 10/2007 Schulze Beekinghausen
9,995,095 B2 * 6/2018 Thibodeaux ..... E21B 19/164
10,006,260 B2 * 6/2018 Webre ..... E21B 19/164
11,613,941 B2 * 3/2023 Webre ..... E21B 19/165 81/57.18
2020/0284107 A1 9/2020 Webre et al.
2021/0239206 A1 8/2021 Al Harthi

FOREIGN PATENT DOCUMENTS

CN 202140048 U 2/2012
CN 107191144 B 9/2018
CN 107165588 B 10/2018
CN 107386997 B 12/2018

* cited by examiner

*Primary Examiner* — David B. Thomas
(74) *Attorney, Agent, or Firm* — DINSMORE & SHOHL LLP

(57) ABSTRACT

A power tong assembly for making and breaking a tubular connection may include a first tong operable to engage a first tubular and a second tong operable to engage and rotate a second tubular relative to the first tubular to make or break the tubular connection. The second tong may include a rotation lever operable to set rotation of the second tong to a makeup setting or a break out setting and a speed lever operable to set rotation speed of the second tong in a low speed position or a high speed position. A system for selectively preventing high speed rotation of the power tong comprising a rotation lever position locking element and a coupling mechanism. The rotation lever position locking element may be movable between a blocking position and a non-blocking position. The coupling mechanism may couple the rotation lever position locking element to the speed lever.

20 Claims, 4 Drawing Sheets

SYSTEMS AND ASSEMBLIES FOR PREVENTING UNDESIRED HIGH SPEED ROTATION OF POWER TONGS

BACKGROUND

Field

The present disclosure relates to systems and assemblies for selectively preventing undesired high speed rotation of power tongs.

Technical Background

The drilling and completion processes of wells requires numerous tubular sections. During the drilling process, individual sections of drill pipe are coupled together as the drill string extends into the formation. After the drilling process, various other tubulars (e.g., casing, tubing, tie-backs, etc.) may be coupled together as they are inserted into the resulting wellbore. These tubulars may be coupled together using rotational energy provided by workers on the rig, or, in many cases, through the use of power tongs. Power tongs are large-capacity, self-locking wrenches used to grip tubular sections and apply torque. While extending a tubular section into the wellbore, the power tongs are set to a makeup position. While retrieving a tubular section from the wellbore, the power tongs are set to a break out position.

SUMMARY

Tubular running services are one of the many services provide in drilling and workover operations. Power tongs are one of many tools that may be used during tubular running services.

During operation of a power tong, an operator may either add tubular sections or remove tubular sections from a tubular string (i.e., a series of connected tubulars). Adding additional tubular sections to the tubular string may be referred to as makeup, whereas removing tubular sections from the tubular string may be referred to as break out. During makeup or break out, it may be necessary to briefly switch rotation of the power tong to break out or makeup, respectively. This may be due to cross-threading of the tubular sections or to release the catcher dies (the portion of the power tongs which grip the tubular sections before torque is applied) of the power tong from the tubular. While one or more snap lines may be used to isolate the power tong from undesirably rotating when the rotation of the power tong is switched, the one or more snap lines may not always be effective. Therefore, operators may be hesitant to switch the direction of rotation of the power tong from makeup to break out. The brief hesitation to switch direction adds up, effectively costing lengthy delays in tubular running services.

Accordingly, there is an ongoing need for systems and assemblies for preventing undesirable high speed rotation of power tongs. The present disclosure is directed to systems for selectively preventing high speed rotation of a power tong. The present disclosure is also directed to assemblies for making and breaking tubular connections. More specifically, the present disclosure may feature a rotation lever position locking element movable between a blocking position and a non-blocking position that is coupled to the speed lever of the power tong. As further described herein, undesirable high speed rotation of power tongs may efficiently be accomplished using the systems and assemblies of the present disclosure.

According to one or more aspects of the present disclosure, a system for selectively preventing high speed rotation of a power tong may include a rotation lever position locking element, and a coupling mechanism. The power tong may have a rotation lever operable to set rotation of the power tong to a makeup setting when the rotation lever is in a first position or a break out setting when the rotation lever is in a second position. The power tong may have a speed lever operable to set the rotation speed of the power tong to a low speed when the speed lever is in a low speed position or a high speed when the speed lever is in a high speed position. The rotation lever position locking element may be movable between a blocking position wherein the rotation lever position locking element blocks movement of the rotation lever between the first position and the second position and a non-blocking position wherein the rotation lever position locking element does not block movement of the rotation lever. The coupling mechanism may couple the rotation lever position locking element to the speed lever such that movement of the speed lever from the low speed position to the high speed position moves the rotation lever position locking element from the non-blocking position to the blocking position and movement of the speed lever from the high speed position to the low speed position moves the rotation lever position locking element from the blocking position to the non-blocking position.

According to one or more aspects of the present disclosure, a power tong assembly for making and breaking a tubular connection. The power tong assembly may include a first tong operable to engage a first tubular, a second tong operable to engage and rotate a second tubular relative to the first tubular to make or break the tubular connection. The second tong may include a rotation lever, a speed lever, and a system for selectively preventing high speed rotation of the power tong. The rotation lever may be operable to set rotation of the second tong to a makeup setting when the rotation lever is in a first position or a break out setting when the rotation lever is in a second position. The speed lever may be operable to set rotation speed of the second tong in a low speed position or a high speed position. The system for selectively preventing high speed rotation of the power tong may include a rotation lever position locking element and a coupling mechanism. The rotation lever position locking element may be movable between a blocking position wherein the rotation lever position locking element blocks movement of the rotation lever between the first position and the second position and a non-blocking position wherein the rotation lever position locking element does not block movement of the rotation lever. The coupling mechanism may couple the rotation lever position locking element to the speed lever such that movement of the speed lever from the low speed position to the high speed position moves the rotation lever position locking element from the non-blocking position to the blocking position and movement of the speed lever from the high speed position to the low speed position moves the rotation lever position locking element from the blocking position to the non-blocking position.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments of the present disclosure, some embodiments of which are illustrated in the accompanying drawings. Whenever possible, the same reference numerals will be used throughout the drawings to refer to the same or similar parts.

DETAILED DESCRIPTION

Figure 1:
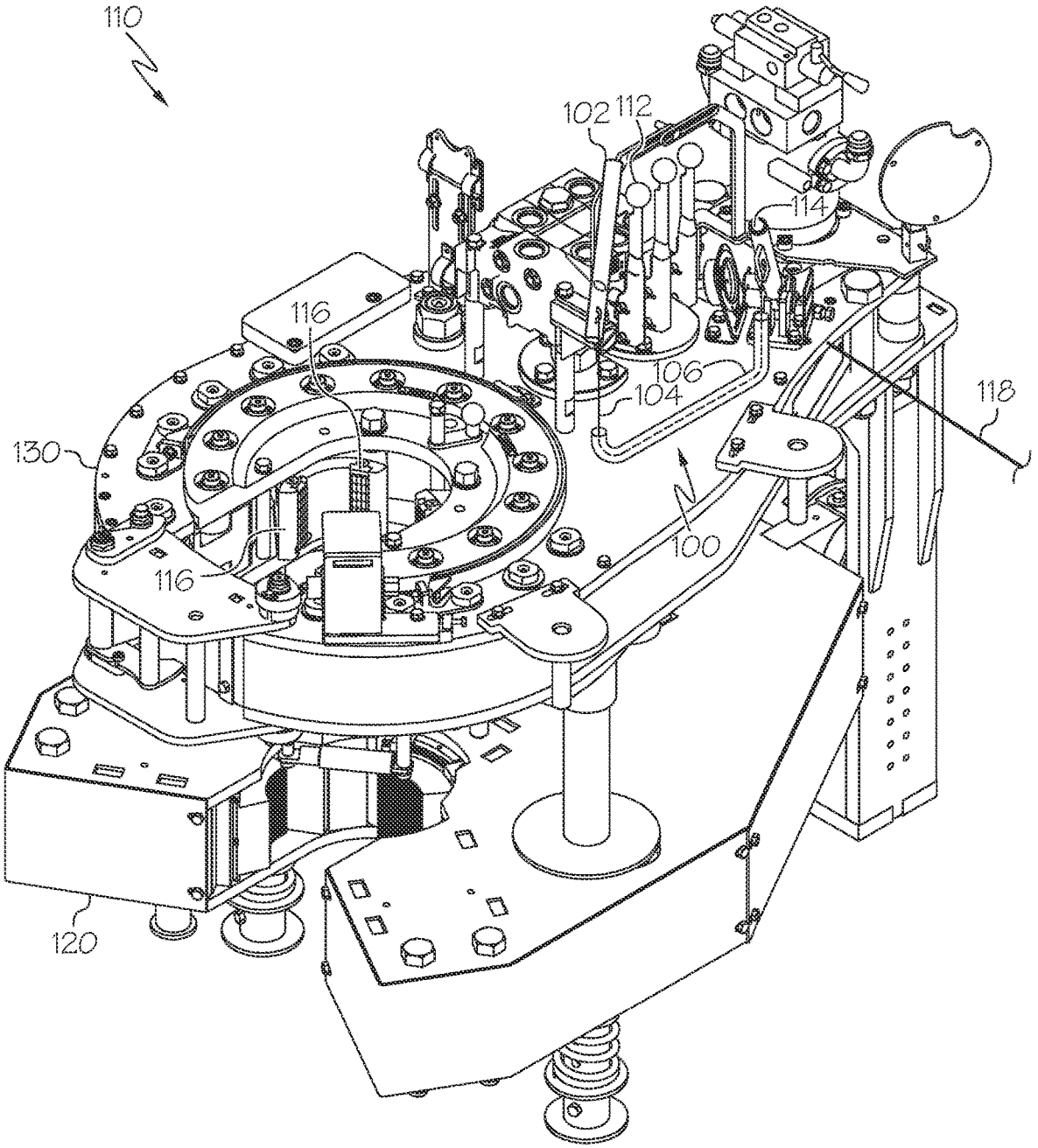
FIG. 1 schematically depicts a system for selectively preventing high speed rotation of a power tong with the speed lever in the low speed position, according to one or more embodiments shown and described in this disclosure.

The present disclosure is directed to systems for selectively preventing high speed rotation of a power tong. The power tong may include a rotation lever operable to set rotation of the power tong to a makeup setting when the rotation lever is in a first position or a break out setting when the rotation lever is in a second position. The power tong may also include a speed lever operable to set the rotation speed of the power tong to a low speed when the speed lever is in a low speed position or a high speed when the speed lever is in a high speed position. The systems may include a rotation lever position locking element. The rotation lever position locking element may be movable between a blocking position wherein the rotation lever position locking element blocks movement of the rotation lever between the first position and the second position and a non-blocking position wherein the rotation lever position locking element does not block movement of the rotation lever. The system may further include a coupling mechanism coupling the rotation lever position locking element to the speed lever such that movement of the speed lever from the low speed position to the high speed position may move the rotation lever position locking element from the non-blocking position to the blocking position. Movement of the speed lever from the high speed position to the low speed position may move the rotation lever position locking element from the blocking position to the non-blocking position.

The present disclosure is also directed to power tong assemblies for making and breaking a tubular connection. The power tong assemblies may include a first tong operable to engage a first tubular, a second tong operable to engage and rotate a second tubular relative to the first tubular to make or break the tubular connection. The second tong may include a rotation lever operable to set rotation of the power tong to a makeup setting when the rotation lever is in a first position or a break out setting when the rotation lever is in a second position. The second tong may also include a speed lever operable to set rotation speed of the second tong in a low speed position or a high speed position. The power tong assemblies for making and breaking a tubular connection may also include a system for selectively preventing high speed rotation of the power tong comprising a rotation lever position locking element and a coupling mechanism. The rotation lever position locking element may be movable between a blocking position wherein the rotation lever position locking element blocks movement of the rotation lever between the first position and the second position and a non-blocking position wherein the rotation lever position locking element may not block movement of the rotation lever. The coupling mechanism may couple the rotation lever position locking element to the speed lever such that movement of the speed lever from the low speed position to the high speed position moves the rotation lever position locking element from the non-blocking position to the blocking position and movement of the speed lever from the high speed position to the low speed position may move the rotation lever position locking element from the blocking position to the non-blocking position.

The various systems and assemblies for selectively preventing high speed rotation of the power tong may provide increased efficiency for making and breaking tubular connections. That is, the various systems and assemblies may provide reassurance for operators that no undesirable rotation of the power tong will occur due to the rotation being changed while the power tong is in the high speed setting. The systems and assemblies of the present disclosure may increase efficiency during tubular running services.

As used throughout the present disclosure, the term "power tong" may refer to a large-capacity, self-locking wrench used to grip drillstring components (e.g., tubulars) and apply torque. Power tongs are typically used in opposing pairs.

As used throughout the present disclosure, the term "tubular connection" may refer to any threaded or non-threaded union or joint that connects two tubular components. The tubular components may include drill pipes, casings, tubings, or tiebacks.

Reference is made in the present disclosure to makeup and break out settings. As used in the present disclosure, "makeup" may refer to the process of joining tubular components. "Break out" may refer to the process of disjoining tubular components.

Figure 2:
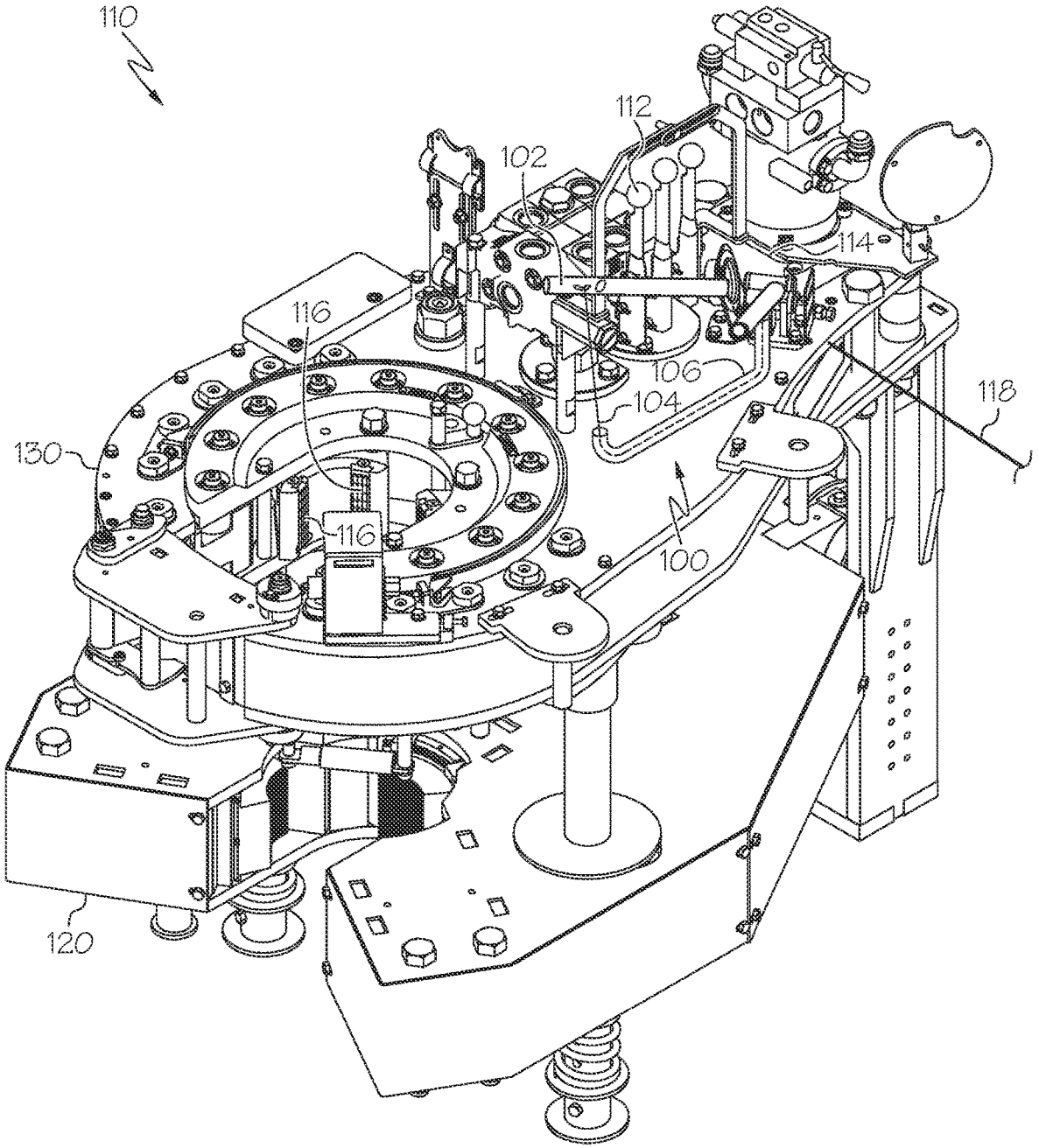
FIG. 2 schematically depicts a system for selectively preventing high speed rotation of a power tong with the speed lever in the high speed position, according to one or more embodiments shown and described in this disclosure.

Referring to FIGS. 1 and 2, a system 100 for selectively preventing high speed rotation of a power tong 110 may include a rotation lever position locking element 102 and a coupling mechanism 104. The power tong 110 may include a rotation lever 112 and a speed lever 114. The rotation lever 112 may be operable to set rotation of the power tong 110 to a makeup setting or a break out setting. The rotation of the power tong 110 may be set to the makeup setting when the rotation lever 112 is in a first position (such as, when the rotation lever 112 is pushed forward relative to its neutral position). The rotation of the power tong 110 may be set to the break out setting when the rotation lever 112 is in a second position (such as, when the rotation lever 112 is pulled back relative to its neutral position). The speed lever 114 may be operable to set the rotation speed of the power tong 110 to a low speed or a high speed. The rotation speed of the power tong 110 may be low speed when the speed lever 114 is in a low speed position (as shown in FIG. 1). The rotation speed of the power tong 110 may be high speed when the speed lever 114 is in a high speed position (as shown in FIG. 2). The system 100 for selectively preventing high speed rotation of the power tong 110 may include a rotation lever position locking element 102 and a coupling mechanism 104. The rotation lever position locking element 102 may be movable between a blocking position (as shown in FIG. 2) and a non-blocking position (as shown in FIG. 1). In the blocking position, the rotation lever position locking element 102 blocks movement of the rotation lever 112 between the first position and the second position. In the non-blocking position, the rotation lever position locking element 102 does not block movement of the rotation lever 112. The coupling mechanism 104 may couple the rotation lever position locking element 102 to the speed lever 114. Movement of the speed lever 114 from the low speed position to the high speed position may move the rotation lever position locking element 102 from the non-blocking position to the blocking position. Movement of the speed lever 114 from the high speed position to the low speed position may move the rotation lever position locking element 102 from the blocking position to the non-blocking position.

Systems 100 of the present disclosure for selectively preventing high speed rotation of a power tong 110 may be implemented with any conventional or yet to be developed power tong 110. A person having ordinary skill in the art will appreciate the applicability of the systems 100 of the present disclosure to any power tong 110 having a rotation lever 112 and a speed lever 114.

Referring still to FIGS. 1 and 2, as previously described in the present disclosure, the power tong 110 may include the rotation lever 112. The rotation lever 112 may be operable to set the power tong 110 to the makeup setting (i.e., the first position) or the break out setting (i.e., the second position). Also as previously described in the present disclosure, the power tong 110 may include the speed lever 114. The speed lever 114 may be operable to set the power tong 110 to the low speed or high speed position. The low speed position may be operable to spin catcher dies 116 of the power tong 110 at a rate of approximately 10 revolutions per minute (RPM). The high speed position may be operable to spin catcher dies 116 of the power tong 110 at a rate of approximately 60 to 100 RPM. Both the rotation lever 112 and the speed lever 114 may be positioned on one side of the power tong 110 such that a single operator may control both the rotation lever 112 and the speed lever 114.

The power tong 110 may also include one or more snap lines 118. The snap line 118 may be fixed to the power tong 110 and tied off at a snap point (not shown) that is independent and separate from the power tong 110. The snap line 118 may prevent undesirable rotation of the power tong 110. Due to limited space on many rig floors, it is not uncommon that only one snap line 118 may be used. While in the makeup setting, the snap line 118 may prevent the power tong 110 from rotating away from the operator. However, when only one snap line 118 is used, a change from the makeup setting to the break out setting with the speed lever 114 in the high speed position may cause the power tong 110 to rotate towards the operator. The assemblies and systems 100 of the present disclosure may prevent undesirable rotation of the power tong 110. The assemblies and systems 100 of the present disclosure may require that the speed lever 114 be switched to the low speed positon prior to changing the rotation of the power tong 110, such that the power tong 110 cannot undesirably rotate towards the operator at a high rate of speed. It is contemplated that the assemblies and systems 100 of the present disclosure may not eliminate rotation of the power tong 110 toward the operator entirely, but the assemblies and systems 100 of the present disclosure may reduce the rate of speed at which the power tong 110 may rotate towards the operator.

Referring to FIG. 1, the rotation lever position locking element 102, while in the non-blocking position, may allow movement of the rotation lever 112 when the speed lever 114 is in the low speed position. Alternatively, as shown in FIG. 2, the rotation lever position locking element 102, while in the blocking position, may prevent movement of the rotation lever 112 when the speed lever 114 is in the high speed position. The rotation lever position locking element 102 may be an elongate element, such as a tube or bar, that is pivotally attached to the power tong 110. As the rotation lever position locking element 102 pivotally rotates, a distal end 103 of the rotation lever position locking element 102 may either allow movement of the rotation lever 112 (i.e., the non-blocking position when the speed lever 114 is in the low speed position) or prevent movement of the rotation lever 112 (i.e., the blocking position when the speed lever 114 is in the high speed position). One skilled in the art will appreciate that the rotation lever position locking element 102 may take on many forms so long as the rotation lever position locking element 102 is operable to transition from the non-blocking position when the speed lever 114 is in the low speed position to the blocking position when the speed lever 114 is in the high speed position.

Figure 4:
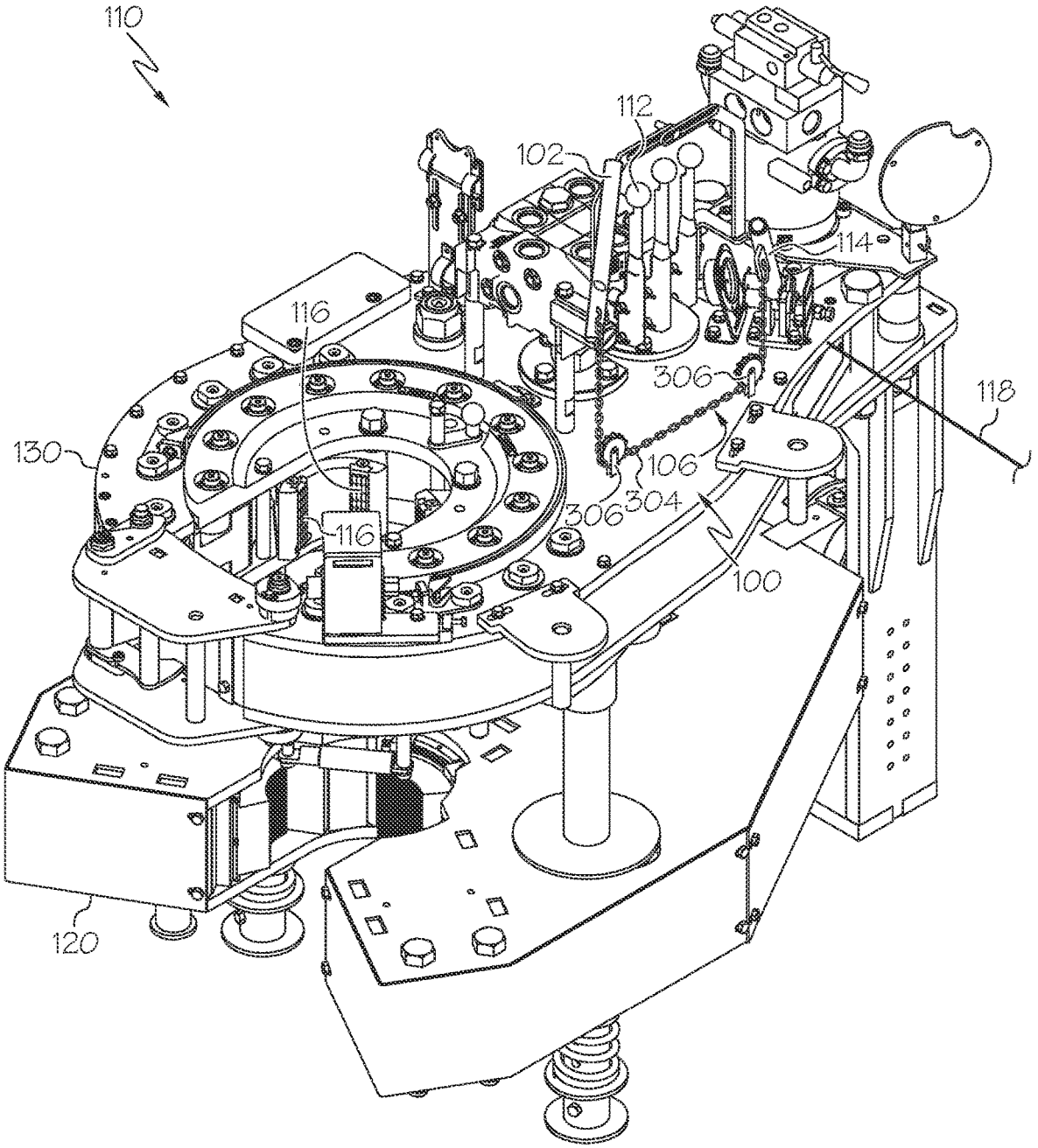
FIG. 4 schematically depicts yet another system for selectively preventing high speed rotation of a power tong with the speed lever in the low speed position, according to one or more embodiments shown and described in this disclosure.

Referring again to FIGS. 1 and 2, as previously described in the present disclosure, the coupling mechanism 104 couples the rotation lever position locking element 102 to the speed lever 114. It is contemplated that the rotation lever position locking element 102 may be attached to the power tong 110 in any suitable fashion, such as to the guard around the rotation lever 112. It is also contemplated that any means may be used to functionally couple the rotation lever position locking element 102 to the speed lever 114, such as a mechanical couple. The coupling mechanism 104 may be a cable. As used in the present disclosure, a "cable" may refer to either a rope of wire or nonmetallic fiber or a wire rope or metal chain. In embodiments, the coupling mechanism 104 may include a wire. As used in the present disclosure, a "wire" may refer to material drawn out into the form of a thin flexible thread or rod. The wire may be a flat wire or a round wire. In other embodiments, as shown in FIG. 4, the coupling mechanism 104 may comprise a chain 304. As used in the present disclosure, a "chain" may refer to a connected flexible series of links.

Figure 3:
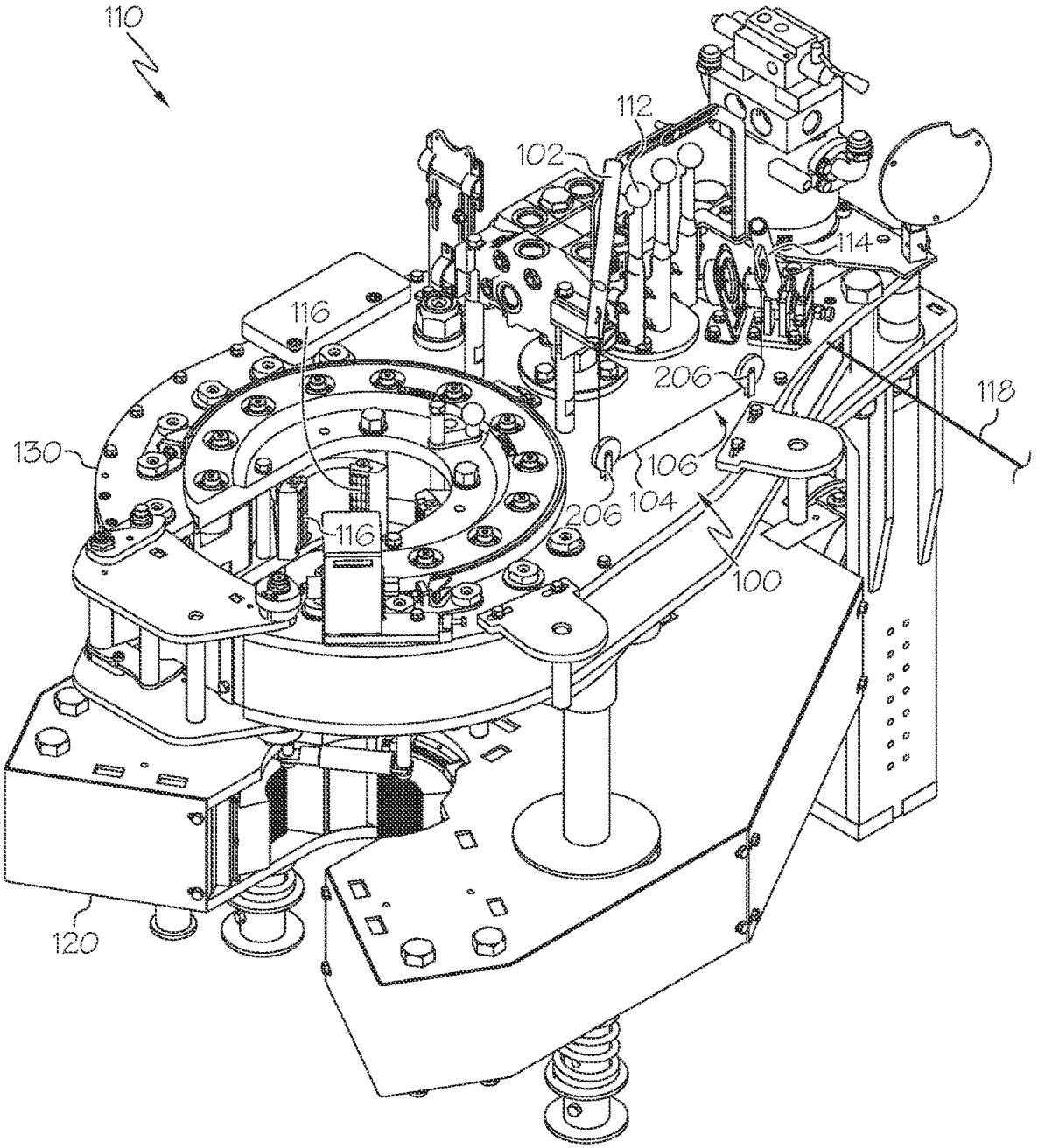
FIG. 3 schematically depicts another system for selectively preventing high speed rotation of a power tong with the speed lever in the low speed position, according to one or more embodiments shown and described in this disclosure.

In embodiments, the system 100 may include a coupling mechanism guide 106. The coupling mechanism guide 106 may be operable to route the coupling mechanism 104 between the rotation lever position locking element 102 and the speed lever 114. In embodiments, the coupling mechanism guide 106 may include one or more hollow members, such as a channel, one or more pipes, one or more pulleys 206 (see FIG. 3), one or more gears 306 (see FIG. 4), or a combination of these. The coupling mechanism guide 106 may be attached to the power tong 110. The coupling mechanism guide 106 may be attached via an adhesive, hardware (e.g., screws, nuts and bolts, etc.), one or more welds, or a combination of these. The systems 100 of the present disclosure for preventing high speed rotation of power tongs 110 may be a mechanical system that is external to the power tong. In embodiments, the systems 100 of the present disclosure may be added to an existing power tong 110 without modification to the internal structure or internal operation of the power tong 110 itself. That is, installation of the systems 100 of the present disclosure may not affect or modify the operation of the power tong 110 itself. Instead, the systems 100 of the present disclosure may only operate to prevent high speed rotation of power tongs 110 that is undesirable.

In an embodiment, the coupling mechanism guide 106 comprises a hollow member and the coupling mechanism 104 comprises a cable. Referring to FIGS. 1 and 2, the coupling mechanism guide 106 may comprise a hollow member, such as one or more pipes, to form the path for the coupling mechanism 104. The coupling mechanism 104 may include a wire that attaches and couples the speed lever 114 to the rotation lever position locking element 102. As shown in FIG. 1, when the speed lever 114 is in the low speed position, the rotation lever 112 is unrestricted and may be freely changed from the makeup setting to the break out setting. As shown in FIG. 2, when the speed lever 114 is in the high speed position, the rotation lever position locking element 102 may restrict movement of the rotation lever 112 and prevent a change from the makeup setting to the break out setting.

It is contemplated that various other components or tools may be added to the system 100 for selectively preventing high speed rotation of a power tong 110 as necessary. Depending on, for example, the power tong 110, a person having ordinary skill in the art may recognize that additional components or tools may be beneficial to add to the systems 100 of the present disclosure.

Referring again to FIGS. 1 and 2, a power tong 110 assembly for making and breaking a tubular connection may include a first tong 120 and a second tong 130. The first tong 120 may be operable to engage a first tubular. The second tong 140 may be operable to engage and rotate a second tubular relative to the first tubular to make or break the tubular connection. The second tong 130 may include a rotation lever 112, a speed lever 114, and a system 100 for selectively preventing high speed rotation of the power tong 110. The rotation lever 112, the speed lever 114, and the system 100 for selectively preventing high speed rotation of the power tong 110 may include any features or components as previously described in the present disclosure.

As previously described in the present disclosure, the rotation lever 112 may be operable to set rotation of the power tong 110 to a makeup setting or a break out setting. The rotation lever 112 may be operable to set rotation of the power tong 110 to the makeup setting when the rotation lever 112 is in a first position. The rotation lever 112 may be operable to set rotation of the power tong 110 to the break out setting when the rotation lever 112 is in a second position. The speed lever 114 may be operable to set rotation speed of the second tong 130 in a low speed position or a high speed position. The system 100 for selectively preventing high speed rotation of the power tong 110 may include a rotation lever position locking element 102 and a coupling mechanism 104. The rotation lever position locking element 102 may be movable between a blocking position and a non-blocking position. In the blocking position, the rotation lever position locking element 102 may block movement of the rotation lever 112 between the first position and the second position. In the non-blocking position, the rotation lever position locking element 102 may not block movement of the rotation lever 112. The coupling mechanism 104 may couple the rotation lever position locking element 102 to the speed lever 114. Movement of the speed lever 114 from the low speed position to the high speed position may move the rotation lever position locking element 102 from the non-blocking position to the blocking position. Movement of the speed lever 114 from the high speed position to the low speed position may move the rotation lever position locking element 102 from the blocking position to the non-blocking position.

A coupling mechanism guide 106 may be attached to the second tong 130. The second tong 130 may refer to the power tong 110 in general as previously discussed with respect to the system of the present disclosure. That is, the coupling mechanism guide 106 may be attached to the power tong 110 that is operable to engage and rotate a second tubular relative to the first tubular to make or break the tubular connection, which includes the rotation lever 112 and the speed lever 114.

One or more aspects of the present disclosure are described herein. A first aspect of the present disclosure may include a system for selectively preventing high speed rotation of a power tong. The power tong may have a rotation lever operable to set rotation of the power tong to a makeup setting when the rotation lever is in a first position or a break out setting when the rotation lever is in a second position. The power tong may have a speed lever operable to set the rotation speed of the power tong to a low speed when the speed lever is in a low speed position or a high speed when the speed lever is in a high speed position. The system may include a rotation lever position locking element movable between a blocking position wherein the rotation lever position locking element blocks movement of the rotation lever between the first position and the second position and a non-blocking position wherein the rotation lever position locking element does not block movement of the rotation lever. The system may include a coupling mechanism coupling the rotation lever position locking element to the speed lever such that movement of the speed lever from the low speed position to the high speed position moves the rotation lever position locking element from the non-blocking position to the blocking position and movement of the speed lever from the high speed position to the low speed position moves the rotation lever position locking element from the blocking position to the non-blocking position.

A second aspect of the present disclosure may include the first aspect, wherein the rotation lever position locking element in the blocking position prevents movement of the rotation lever when the speed lever is in the high speed position.

A third aspect of the present disclosure may include either the first or second aspect, wherein the system further comprises a coupling mechanism guide operable to route the coupling mechanism between the rotation lever position locking element and the speed lever.

A fourth aspect of the present disclosure may include the third aspect, wherein the coupling mechanism guide is attached to the power tong.

A fifth aspect of the present disclosure may include either the third or fourth aspect, wherein the coupling mechanism guide comprises a hollow member and the coupling mechanism comprises a cable.

A sixth aspect of the present disclosure may include any one of the third through fifth aspects, wherein the coupling mechanism guide comprises one or more pipes.

A seventh aspect of the present disclosure may include any one of the third through sixth aspects, wherein the coupling mechanism guide comprises one or more gears.

An eighth aspect of the present disclosure may include any one of the third through seventh aspects, wherein the coupling mechanism comprises a wire, a chain, or a combination of these.

A ninth aspect of the present disclosure may include any one of the third through eighth aspects, wherein the rotation lever position locking element comprises an elongate body pivotally attached to the power tong.

A tenth aspect of the present disclosure may include any one of the third through ninth aspects, wherein the rotation lever position locking element, the coupling mechanism, or both are formed from stainless steel.

An eleventh aspect of the present disclosure may include a power tong assembly for making and breaking a tubular connection. The power tong assembly may include a first tong operable to engage a first tubular and a second tong operable to engage and rotate a second tubular relative to the first tubular to make or break the tubular connection. The second tong may include a rotation lever operable to set rotation of the second tong to a makeup setting when the rotation lever is in a first position or a break out setting when the rotation lever is in a second position. The second tong may include a speed lever operable to set rotation speed of the second tong in a low speed position or a high speed position. The second tong may include a system for selectively preventing high speed rotation of the power tong comprising a rotation lever position locking element and a coupling mechanism. The rotation lever position locking element may be movable between a blocking position wherein the rotation lever position locking element blocks movement of the rotation lever between the first position and the second position and a non-blocking position wherein the rotation lever position locking element does not block movement of the rotation lever. The coupling mechanism may couple the rotation lever position locking element to the speed lever such that movement of the speed lever from the low speed position to the high speed position moves the rotation lever position locking element from the non-blocking position to the blocking position and movement of the speed lever from the high speed position to the low speed position moves the rotation lever position locking element from the blocking position to the non-blocking position.

A twelfth aspect of the present disclosure may include the eleventh aspect, wherein in the system for selectively preventing high speed rotation of the power tong further comprises a coupling mechanism guide operable to route the coupling mechanism between the rotation lever position locking element and the speed lever.

A thirteenth aspect of the present disclosure may include the twelfth aspect, wherein the coupling mechanism guide is attached to the second tong.

A fourteenth aspect of the present disclosure may include either the twelfth or thirteenth aspect, wherein the coupling mechanism guide is welded to the second tong.

A fifteenth aspect of the present disclosure may include any one of the twelfth through fourteenth aspects, wherein the coupling mechanism guide comprises a hollow member and the coupling mechanism comprises a cable.

A sixteenth aspect of the present disclosure may include any one of the twelfth through fifteenth aspects, wherein the coupling mechanism guide comprises one or more pipes.

A seventeenth aspect of the present disclosure may include any one of the eleventh through sixteenth aspects, wherein the coupling mechanism guide comprises one or more gears.

An eighteenth aspect of the present disclosure may include any one of the twelfth through seventeenth aspects, wherein the coupling mechanism comprises a wire, a chain, or a combination of these.

A nineteenth aspect of the present disclosure may include any one of the eleventh through eighteenth aspects, wherein the rotation lever position locking element comprises an elongate body pivotally attached to the power tong.

A twentieth aspect of the present disclosure may include any one of the eleventh through nineteenth aspects, wherein the rotation lever position locking element, the coupling mechanism, or both are formed from stainless steel.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A system for selectively preventing high speed rotation of a power tong, the power tong having a rotation lever operable to set rotation of the power tong to a makeup setting when the rotation lever is in a first position or a break out setting when the rotation lever is in a second position, and a speed lever operable to set the rotation speed of the power tong to a low speed when the speed lever is in a low speed position or a high speed when the speed lever is in a high speed position, the system comprising:

a rotation lever position locking element movable between a blocking position wherein the rotation lever position locking element blocks movement of the rotation lever between the first position and the second position and a non-blocking position wherein the rotation lever position locking element does not block movement of the rotation lever; and a coupling mechanism coupling the rotation lever position locking element to the speed lever such that movement of the speed lever from the low speed position to the high speed position moves the rotation lever position locking element from the non-blocking position to the blocking position and movement of the speed lever from the high speed position to the low speed position moves the rotation lever position locking element from the blocking position to the non-blocking position.

2. The system of claim 1, wherein the rotation lever position locking element in the blocking position prevents movement of the rotation lever when the speed lever is in the high speed position.

3. The system of claim 1, wherein the system further comprises a coupling mechanism guide operable to route the coupling mechanism between the rotation lever position locking element and the speed lever.

4. The system of claim 3, wherein the coupling mechanism guide is attached to the power tong.

5. The system of claim 3, wherein the coupling mechanism guide comprises a hollow member and the coupling mechanism comprises a cable.

6. The system of claim 3, wherein the coupling mechanism guide comprises one or more pipes.

7. The system of claim 3, wherein the coupling mechanism guide comprises one or more gears.

8. The system of claim 1, wherein the coupling mechanism comprises a wire, a chain, or a combination of these.

9. The system of claim 1, wherein the rotation lever position locking element comprises an elongate body pivotally attached to the power tong.

10. The system of claim 1, wherein the rotation lever position locking element, the coupling mechanism, or both are formed from stainless steel.

11. A power tong assembly for making and breaking a tubular connection, the power tong assembly comprising:

a first tong operable to engage a first tubular;

a second tong operable to engage and rotate a second tubular relative to the first tubular to make or break the tubular connection, wherein the second tong comprises a rotation lever operable to set rotation of the second tong to a makeup setting when the rotation lever is in a first position or a break out setting when the rotation lever is in a second position; and a speed lever operable to set rotation speed of the second tong in a low speed position or a high speed position;

a system for selectively preventing high speed rotation of the power tong comprising a rotation lever position locking element and a coupling mechanism, wherein the rotation lever position locking element is movable between a blocking position wherein the rotation lever position locking element blocks movement of the rotation lever between the first position and the second position and a non-blocking position wherein the rotation lever position locking element does not block movement of the rotation lever; and the coupling mechanism couples the rotation lever position locking element to the speed lever such that movement of the speed lever from the low speed position to the high speed position moves the rotation lever position locking element from the non-blocking position to the blocking position and movement of the speed lever from the high speed position to the low speed position moves the rotation lever position locking element from the blocking position to the non-blocking position.

12. The power tong assembly of claim 11, wherein in the system for selectively preventing high speed rotation of the power tong further comprises a coupling mechanism guide operable to route the coupling mechanism between the rotation lever position locking element and the speed lever.

13. The power tong assembly of claim 12, wherein the coupling mechanism guide is attached to the second tong.

14. The power tong assembly of claim 12, wherein the coupling mechanism guide is welded to the second tong.

15. The power tong assembly of claim 12, wherein the coupling mechanism guide comprises a hollow member and the coupling mechanism comprises a cable.

16. The power tong assembly of claim 12, wherein the coupling mechanism guide comprises one or more pipes.

17. The power tong assembly of claim 11, wherein the coupling mechanism guide comprises one or more gears.

18. The power tong assembly of claim 12, wherein the coupling mechanism comprises a wire, a chain, or a combination of these.

19. The power tong assembly of claim 11, wherein the rotation lever position locking element comprises an elongate body pivotally attached to the power tong.

20. The power tong assembly of claim 11, wherein the rotation lever position locking element, the coupling mechanism, or both are formed from stainless steel.

* * * * *